US008925740B1

(12) United States Patent
Fanok

(10) Patent No.: US 8,925,740 B1
(45) Date of Patent: Jan. 6, 2015

(54) WOMEN'S FOOTWEAR STORAGE ASSEMBLY

(71) Applicant: John Fanok, Clifton, NJ (US)

(72) Inventor: John Fanok, Clifton, NJ (US)

( * ) Notice: Subject to any disclaimer, the term of this patent is extended or adjusted under 35 U.S.C. 154(b) by 0 days.

(21) Appl. No.: 13/967,460

(22) Filed: Aug. 15, 2013

(51) Int. Cl.
*A47F 7/08* (2006.01)
*A47G 25/00* (2006.01)

(52) U.S. Cl.
CPC ..... *A47G 25/005* (2013.01)
USPC ..... 211/34; 211/119.004

(58) Field of Classification Search
USPC ..... 211/34–38, 119.004; 248/317, 320
See application file for complete search history.

(56) References Cited

U.S. PATENT DOCUMENTS

| | | | | | |
|---|---|---|---|---|---|
| 597,734 | A | * | 1/1898 | McConnell | 294/76 |
| 1,977,512 | A | * | 10/1934 | Hills | 211/35 |
| 2,389,910 | A | * | 11/1945 | Hoffman | 211/34 |
| 2,866,559 | A | * | 12/1958 | Byrne | 211/35 |
| 3,292,831 | A | * | 12/1966 | Moen | 294/157 |
| D287,550 | S | | 1/1987 | Tocci | |
| 4,846,430 | A | * | 7/1989 | Ke | 248/215 |
| 5,114,017 | A | | 5/1992 | Doyel | |
| 5,294,007 | A | | 3/1994 | Edmondson | |
| 5,363,953 | A | * | 11/1994 | Carter | 206/6.1 |
| 6,073,643 | A | * | 6/2000 | Zheng | 135/125 |
| D429,897 | S | | 8/2000 | Rogman et al. | |
| 6,357,510 | B1 | * | 3/2002 | Zheng | 160/354 |
| D463,182 | S | | 9/2002 | Klein et al. | |
| 6,467,613 | B2 | * | 10/2002 | Felsenthal | 206/213 |
| 6,581,786 | B1 | | 6/2003 | King et al. | |
| 7,338,131 | B2 | * | 3/2008 | Forgatsch | 297/423.15 |
| 2004/0045915 | A1 | | 3/2004 | Klein et al. | |
| 2006/0049121 | A1 | | 3/2006 | Klein et al. | |
| 2006/0207956 | A1 | * | 9/2006 | Sivers | 211/113 |
| 2010/0270246 | A1 | | 10/2010 | Rodriguez | |
| 2012/0048816 | A1 | | 3/2012 | Brown | |

* cited by examiner

*Primary Examiner* — Korie H Chan

(57) ABSTRACT

A women's footwear storage assembly organizes and stores high-heeled shoes by suspending them above a ground surface. The assembly includes a plurality of interwoven strands. The strands define a net wherein the net has openings extending between adjacently positioned strands. Each of the openings is configured to receive a heel portion of an article of high-heeled footwear. A frame is coupled to and extends around a perimeter edge of the net. The frame is configured thr supporting the net in a stretched position. An upper loop is coupled to a top end of the net. A holding member is selectively couplable to the upper loop and configured for retaining the net in an upright position against a supporting surface.

12 Claims, 5 Drawing Sheets

WOMEN'S FOOTWEAR STORAGE ASSEMBLY

BACKGROUND OF THE DISCLOSURE

1. Field of the Disclosure

The disclosure relates to footwear storage devices and more particularly pertains to a new footwear storage device for organizing and storing high-heeled shoes by suspending them above a ground surface.

2. Summary of the Disclosure

An embodiment of the disclosure meets the needs presented above by generally comprising a plurality of interwoven strands. The strands define a net wherein the net has openings extending between adjacently positioned strands. Each of the openings is configured to receive a heel portion of an article of high-heeled footwear. A frame is coupled to and extends around a perimeter edge of the net. The frame is configured for supporting the net in a stretched position. An upper loop is coupled to a top end of the net. A holding member is selectively couplable to the upper loop and configured for retaining the net in an upright position against a supporting surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
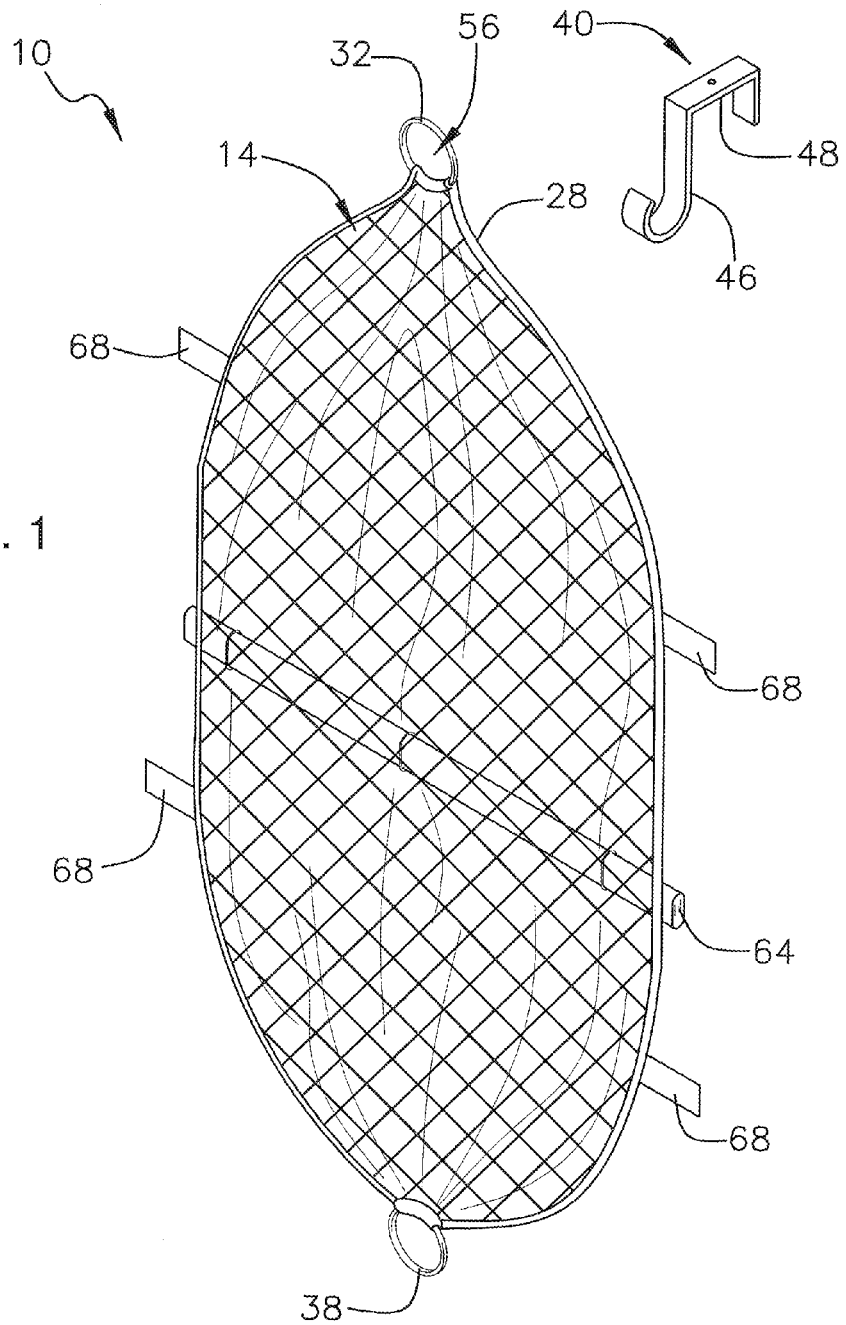
FIG. 1 is a top front side perspective view of a women's footwear storage assembly according to an embodiment of the disclosure.
Figure 2:
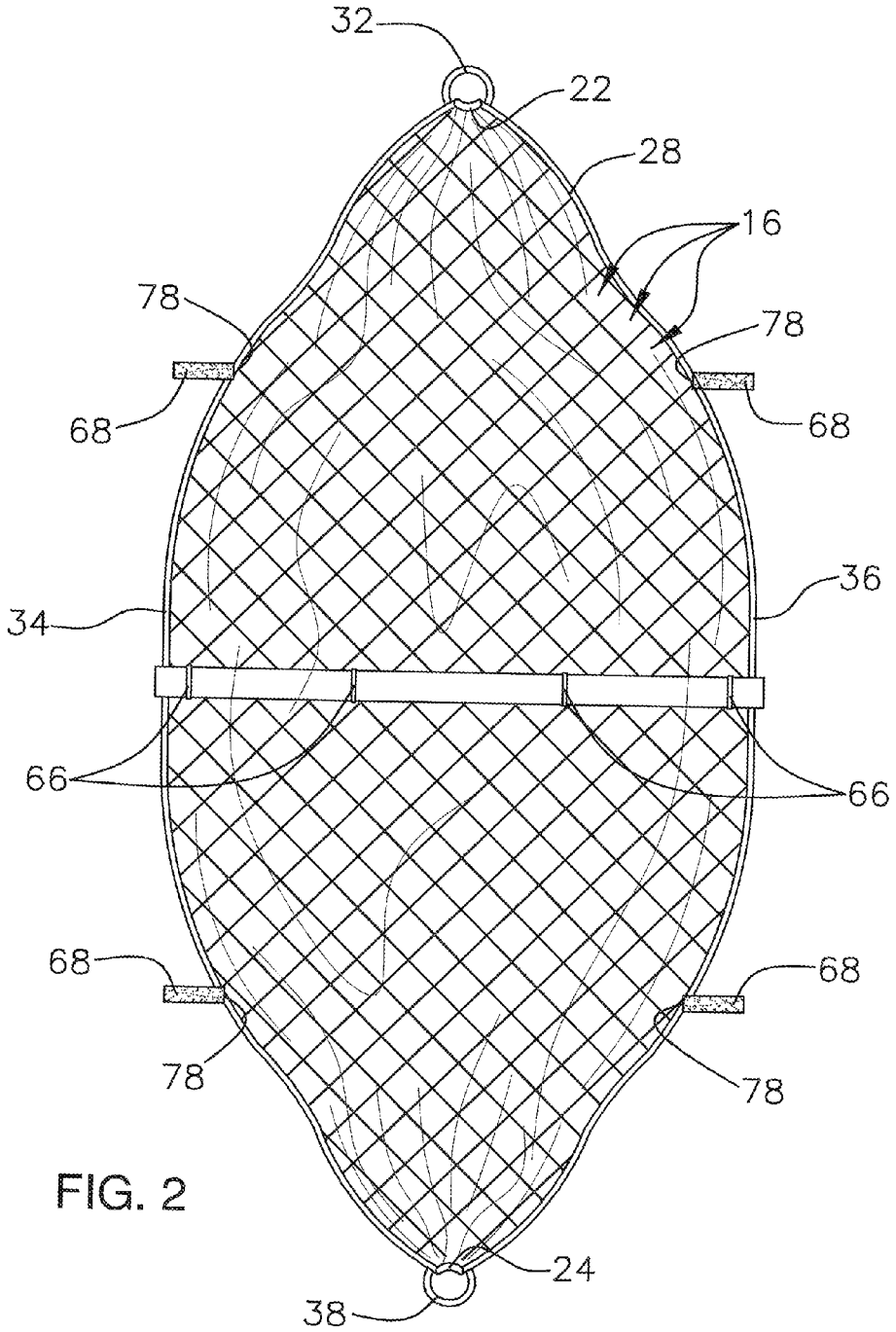
FIG. 2 is a back view of an embodiment of the disclosure.
Figure 3:
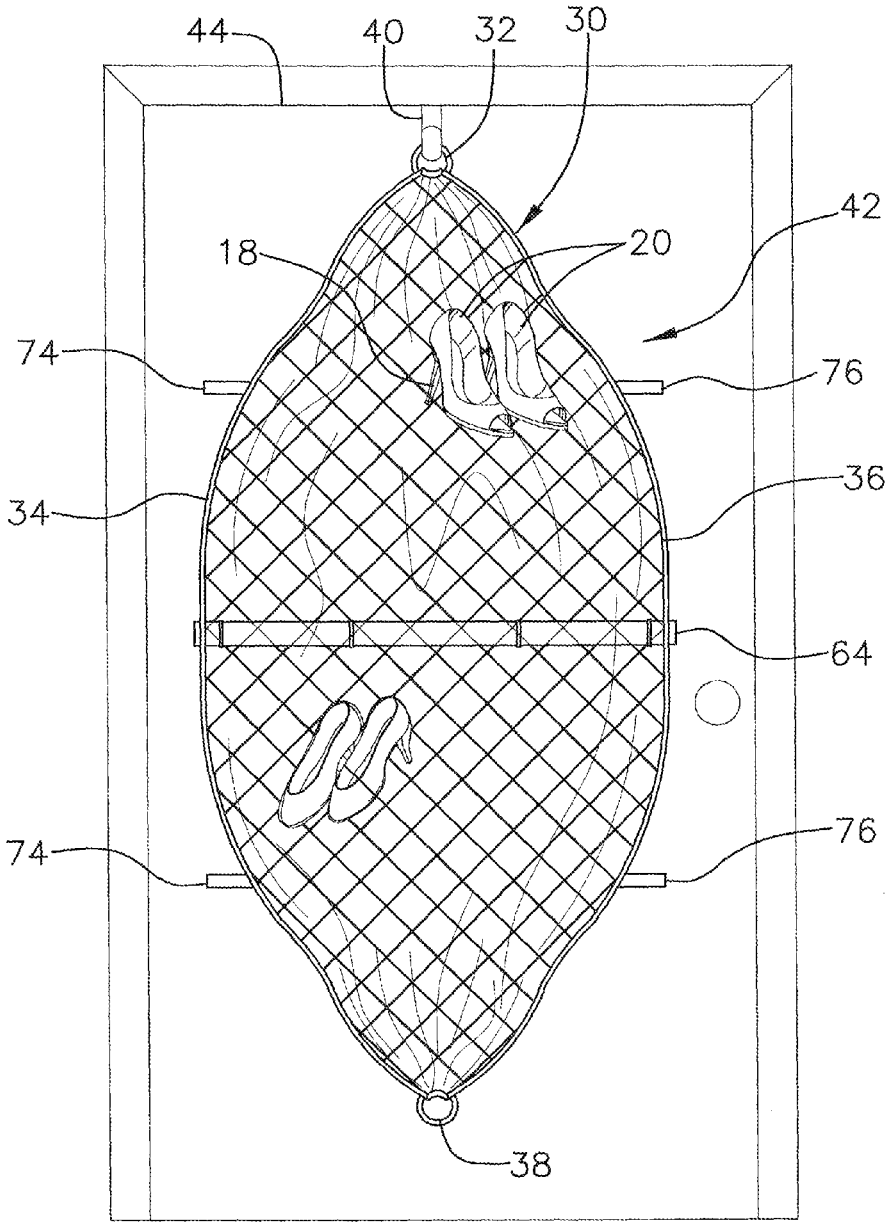
FIG. 3 is a front view of an embodiment of the disclosure.
Figure 4:
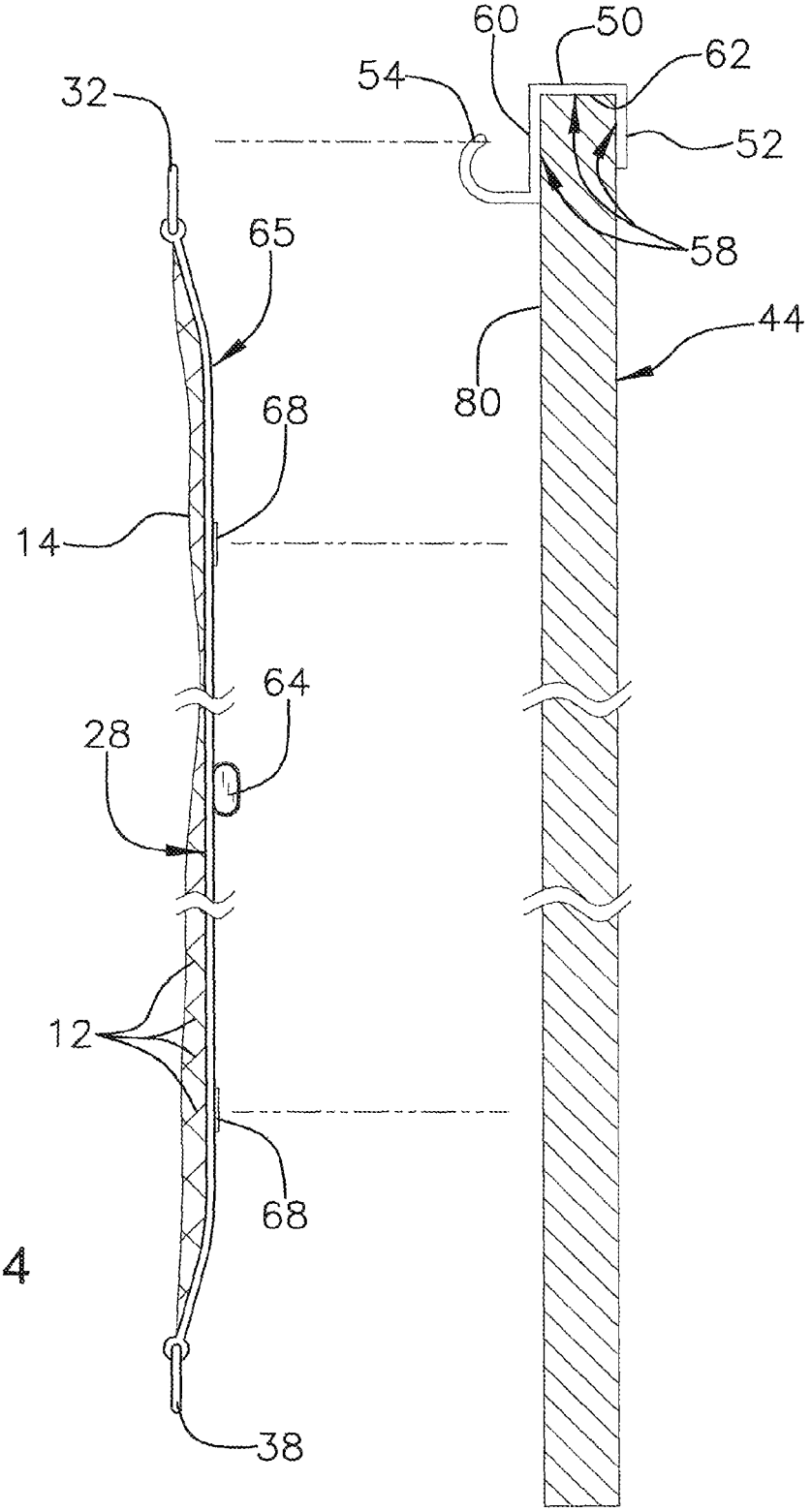
FIG. 4 is a side view of an embodiment of the disclosure.
Figure 5:
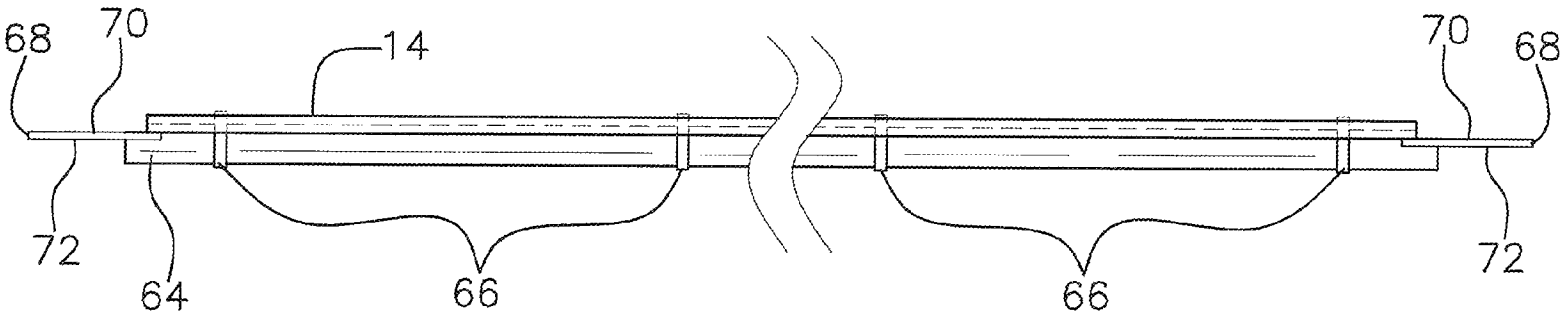
FIG. 5 is a bottom view of an embodiment of the disclosure.

With reference now to the drawings, and in particular to FIGS. 1 through 5 thereof, a new footwear storage device embodying the principles and concepts of an embodiment of the disclosure and generally designated by the reference numeral 10 will be described.

As best illustrated in FIGS. 1 through 5, the women's footwear storage assembly 10 generally comprises a plurality of interwoven strands 12. The strands 12 define a net 14 wherein the net 14 has openings 16 extending between adjacently positioned strands 12. Each of the openings 16 is configured to receive a heel portion 18 of an article of high-heeled footwear 20. The net 14 may comprise a flexible mesh material such as durable nylon or the like. The net 14 may taper toward a top end 22 and a bottom end 24 of the net 14.

A frame 26 is coupled to and extends around a perimeter edge 28 of the net 14. The frame 26 may be constructed from plastic, metal or the like and is configured for supporting the net 14 in a stretched position 30. The frame 26 may be substantially oval-shaped. An upper loop 32 is coupled to the top end 22 of the net 14 and may be coupled to and extend between a first side 34 and a second side 36 of the frame 26. Similarly, a lower loop 38 is coupled to the bottom end 24 of the net 14 and may be coupled to and extend between the first 34 and second 36 sides of the frame 26.

A holding member 40 is selectively couplable to the upper loop 32. The holding member 40 is configured for securing the net 14 in an upright position 42 against a supporting surface 44, such as a door, wall or the like. The holding member 40 may comprise a hook portion 46 and a surface securing portion 48. The surface securing portion 48 has a planar first section 50 and a planar second section 52 being orientated perpendicular to each other. An arcuate end 54 of the hook portion 46 is insertable through an aperture 56 in the upper loop 32 such that the net 14 is supported by the holding member 40. An inner surface 58 of each of the surface securing portion 48 and a straight section 60 of the hook portion 46 is positionable to abut and secure around an upper end 62 of the supporting surface 44. Alternatively, the holding member 40 may comprise a conventional screw inserted through the aperture 56 and secured to the supporting surface 44 in a conventional manner.

A rod 64 is coupled to the net 14. The rod 64 extends between the first 34 and second 36 sides of the frame 26. The rod 64 may be positioned on a back side 65 of the net 14 and be centrally positioned between the top end 22 and the bottom end 24 of the net 14. A plurality of couplers 66 couples the rod 64 to the net 14. Each of the couplers 66 extends around the rod 64 and through an associated one of the openings 16 to secure the rod 64 to the net 14. The couplers 66 may comprise cinched ties or the like.

A plurality of flexible panels 68 is coupled to the net 14. Each of the panels 68 has a top surface 70 and a bottom surface 72. A first pair 74 of the panels 68 is coupled to and extends outwardly from the first side 34 of the frame 26. A second pair 76 of the panels 68 is coupled to and extends outwardly from the second side 36 of the frame 26. Each of the panels 68 has a first end 78 that may be attached to the back side 65 of the net 14. Each of the bottom surfaces 72 has a pressure sensitive adhesive positioned thereon completely covering the bottom surfaces 72 wherein the bottom surfaces 72 are configured for positioning against a front side 80 of the supporting surface 44 to secure the net 14 to the supporting surface 44. Alternatively, hook and loop couplers or like conventional fasteners may be coupled to the net 14 and used in place of the panels 68.

The assembly 10 may have a length between approximately 150.0 centimeters and 250.0 centimeters and a width between approximately 40.0 centimeters and 125.0 centimeters. In this manner, the assembly 10 is designed to hold between approximately two-dozen and three-dozen articles of high-heeled footwear 20.

In use, as stated above and shown in the Figures, the holding member 40 is attached to a supporting surface 44, such as a wall, door or the like. The upper loop 32 is then attached to the holding member 40 as described above such that the net 14 is coupled to the supporting surface 44. The bottom surfaces 72 of the panels 68 are positioned against the front side 80 of the supporting surface 44 to further secure the net 14 to the supporting surface 44. The heel portions 18 of high-heeled footwear 20 are then inserted through the openings 16 in the net 14 to secure the footwear 20 within the net 14. In this manner, the assembly 10 stores and organizes the footwear 20 while also suspending the footwear 20 above a ground surface. The upper loop 32 can be removed from the holding member 40 thereby permitting the footwear 20 to remain organized within the net 14 while being transported.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A women's footwear storage assembly comprising:

a plurality of interwoven strands, said strands defining a net wherein said net has openings extending between adjacently positioned said strands, each of said openings being configured to receive a heel portion of an article of high-heeled footwear;

a frame coupled to and extending around a perimeter edge of said net, said frame being configured for supporting said net in a stretched position;

an upper loop coupled to a top end of said net; and a holding member being selectively couplable to said upper loop, said holding member being configured for retaining said net in an upright position against a supporting surface.

2. The assembly of claim 1, further comprising wherein said net comprises a flexible mesh material.

3. The assembly of claim 1, further comprising said net tapering toward said top end of said net and a bottom end of said net.

4. The assembly of claim 1, further comprising a lower loop coupled to a bottom end of said net.

5. The assembly of claim 1, further comprising said holding member having a hook portion, an arcuate end of said hook portion being insertable through an aperture in said upper loop such that said net is supported by said holding member.

6. The assembly of claim 5, further comprising said holding member having a surface securing portion coupled to said hook portion, said surface securing portion having a planar first section and a planar second section being orientated perpendicular to each other, an inner surface of each of said surface securing portion and a straight section of said hook portion being positionable to abut and secure around an upper end of the supporting surface.

7. The assembly of claim 1, further comprising a rod coupled to said net.

8. The assembly of claim 7, further comprising said rod extending between a first side and a second side of said frame.

9. The assembly of claim 7, further comprising a plurality of couplers coupling said rod to said net, each of said couplers extending around said rod and through an associated one of said openings to secure said rod to said net.

10. The assembly of claim 1, further comprising:

a plurality of flexible panels coupled to said net, each of said panels having a top surface and a bottom surface; and each of said bottom surfaces having a pressure sensitive adhesive positioned thereon completely covering said bottom surfaces wherein said bottom surfaces are configured for positioning against a front side of the supporting surface to secure said net to the supporting surface.

11. The assembly of claim 10, further comprising:

a first pair of said panels being coupled to and extending outwardly from a first side of said frame;

a second pair of said panels being coupled to and extending outwardly from a said second side of said frame; and wherein a first end of each of said panels is attached to a back side of said net.

12. A women's footwear storage assembly comprising:

a plurality of interwoven strands, said strands defining a net wherein said net has openings extending between adjacently positioned said strands, each of said openings being configured to receive a heel portion of an article of high-heeled footwear, said net comprising a flexible mesh material, said net tapering toward a top end and a bottom end of said net;

a frame coupled to and extending around a perimeter edge of said net, said frame being configured for supporting said net in a stretched position;

an upper loop coupled to said top end of said net, said upper loop being coupled to and extending between a first side and a second side of said frame;

a lower loop coupled to said bottom end of said net, said lower loop being coupled to and extending between said first and second sides of said frame;

a holding member being selectively couplable to said upper loop, said holding member being configured for retaining said net in an upright position against a supporting surface, said holding member having a hook portion and a surface securing portion, said surface securing portion having a planar first section and a planar second section being orientated perpendicular to each other, an arcuate end of said hook portion being insertable through an aperture in said upper loop whereby said arcuate end abuts said upper loop such that said net is supported by said holding member, an inner surface of each of said surface securing portion and a straight section of said hook portion being positionable to abut and secure around an upper end of the supporting surface;

a rod coupled to said net, said rod extending between said first and second sides of said frame, said rod being positioned on a back side of said net, said rod being centrally positioned between said top end and said bottom end of said net;

a plurality of couplers coupling said rod to said net, each of said couplers extending around said rod and through an associated one of said openings to secure said rod to said net; and a plurality of flexible panels coupled to said net, each of said panels having a top surface and a bottom surface, a first pair of said panels being coupled to and extending outwardly from said first side of said frame, a second pair of said panels being coupled to and extending outwardly from said second side of said frame, each of said panels having a first end attached to said back side of said net, each of said bottom surfaces having a pressure sensitive adhesive positioned thereon completely covering said bottom surfaces wherein said bottom surfaces are configured for positioning against a front side of the supporting surface to secure said net to the supporting surface.

* * * * *